US006550774B1

(12) United States Patent
Stroll et al.

(10) Patent No.: US 6,550,774 B1
(45) Date of Patent: Apr. 22, 2003

(54) ELECTRO-MECHANICAL COIN OPERATED PRIZE CAPSULE FISHING SIMULATOR GAME SYSTEM

(75) Inventors: Michael Stroll, Libertyville, IL (US); Python Anghelo, Palatine, IL (US); Bryan Hansen, Fox River Grove, IL (US); William Pfutzenreuter, Hoffman Estates, IL (US)

(73) Assignee: Pixy Games, Inc., Libertyville, IL (US)

( * ) Notice: Subject to any disclaimer, the term of this patent is extended or adjusted under 35 U.S.C. 154(b) by 0 days.

(21) Appl. No.: 10/104,077

(22) Filed: Mar. 21, 2002

(51) Int. Cl.[7] ..... A63F 9/00
(52) U.S. Cl. ..... 273/447
(58) Field of Search ..... 273/440, 447, 273/448

(56) References Cited

U.S. PATENT DOCUMENTS

| | | | | | |
|---|---|---|---|---|---|
| 4,272,075 | A | * | 6/1981 | Rogers, Jr. | 273/448 |
| 4,432,544 | A | * | 2/1984 | Wakimura | 273/448 |
| 4,936,574 | A | * | 6/1990 | Lee | 273/447 |
| 5,141,465 | A | * | 8/1992 | Stellman | 273/447 |
| 5,609,340 | A | * | 3/1997 | Chuang | 273/448 |
| 5,609,341 | A | * | 3/1997 | Chuang | 273/448 |
| 5,657,995 | A | * | 8/1997 | Howard | 273/333 |
| 6,164,653 | A | * | 12/2000 | Chuang | 273/447 |
| 6,454,261 | B2 | * | 9/2002 | Ohira | 273/140 |
| 2002/0140171 | A1 | * | 10/2002 | Ochi | 273/448 |

FOREIGN PATENT DOCUMENTS

| | | | | |
|---|---|---|---|---|
| DE | 4230426 A1 | * | 3/1994 | A63F/7/24 |
| JP | 5-76656 | * | 3/1993 | A63F/9/00 |

* cited by examiner

*Primary Examiner*—Raleigh W. Chiu
(74) *Attorney, Agent, or Firm*—Wood, Phillips, Katz, Clark & Mortimer

(57) ABSTRACT

A dispensing fishing game system includes a prize capsule storage bin in the form of a three dimensional play field at the bottom of a cabinet. A drive mechanism controls a fishing rod with lifelike operation. An external fishing rod hand and spool mechanism are activated by a player to manipulate the inside fishing rod mechanism to move side to side, or back and forth, a fishing hook in order for a player to move the hook and snag one of the prizes. Once hooked, the prize is lifted and released over a prize chute which then falls down and rolls into a prize opening for the player to collect.

43 Claims, 13 Drawing Sheets

FIG. 1

ELECTRO-MECHANICAL COIN OPERATED PRIZE CAPSULE FISHING SIMULATOR GAME SYSTEM

FILED OF THE INVENTION

This invention relates, generally, to electro-mechanical games that challenge players to use their motor skills, sense of timing and sense of space in order to win and be rewarded if they play well and more particularly, to a fishing simulator game.

BACKGROUND OF THE INVENTION

One example of an electro-mechanical game is a so-called crane game. Prizes are won by a player manipulating a crane claw over plush animals or other prizes and trying to position and release the crane claw in order to win one of the prizes. Rewards in such games can be difficult to achieve. This is due to the fact that the typical crane claw has difficulty in lifting and holding the prizes.

Another type of such game, which may also be classified as a merchandiser, enables prizes to be won by the player by manipulating a drill type spinning cylinder by positioning it and releasing it forward toward a wall full of holes that hold prizes. If the cylinder penetrates perfectly through the center of a hole in the wall a prize will be pushed through to fall out and enable the player to collect it from a receiving bin.

SUMMARY OF THE INVENTION

The present invention relates generally to a cabinet housing containers or capsules containing prizes. At the front of the cabinet is a control panel with a fishing rod handle and reel mechanism. Mounted in the interior of the cabinet is a boom mechanism supporting a fishing rod, spool and line, with a hook on the distal end of the line. The control panel and boom mechanism are operatively connected to a control system. When the handle and spool mechanism are activated and manipulated by a player, the fishing rod and spool are controlled by the control system to behave and respond to the player's control actions very much like an actual rod and reel. This enables the player to manipulate the hook anywhere inside the cabinet and through the player's skill alone be able to hook any of the prizes by placing a tip of the hook in a loop or hole on the prize. The captured prize can then be lifted like an actual fish and placed over a dispensing outlet to be automatically released. The captured prize is then delivered to a dispensing opening via a prize chute.

The game play can be configured as a skill only game. Alternatively, the game play can be automatically modified like a merchandiser or redemption game. Likewise, the game play can be mathematically, mechanically or electronically set to a game of chance, similar to a slot machine, or any other gaming device.

DETAILED DESCRIPTION OF THE INVENTION

Figure 1:
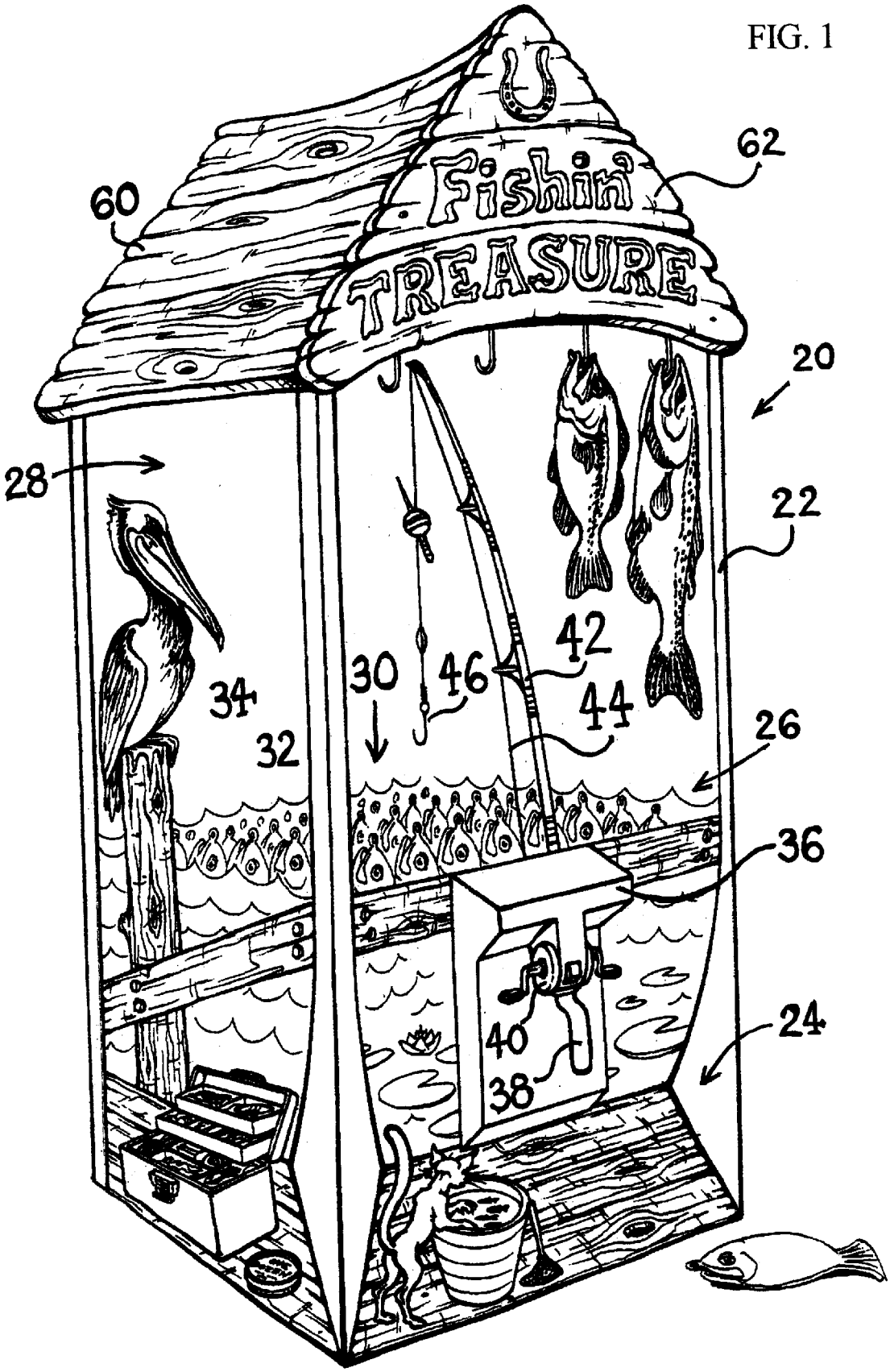
FIG. 1 is a perspective view of an artistic rendering of a dispensing fishing game in accordance with the invention.

Referring to the drawings, and particularly FIG. 1, a dispensing fishing game 20 in accordance with the invention as illustrated. The game 20 comprises an electro-mechanical coin operated fishing simulator game system housed in a modified video game cabinet 22. The cabinet 22 is approximately thirty inches wide, eighty-two inches tall and thirty-three inches deep. The cabinet 22 is effectively divided into a bottom dispensing space 24, a middle prize container holding space 26 and a play area space 28.

The prize container holding space 26 is approximately thirty inches wide, thirty-three inches deep and nineteen inches high and may contain up to two hundred prizes 30. Each prize 30 comprises a container 32 having a hook or loop 34. Particularly, in the illustrated embodiment of the invention, the containers 32 comprise transparent plastic containers configured to resemble a fish. The loop 34 is positioned near the mouth of the fish. While the game 20 is illustrated in connection with plastic, fish shaped containers, other types of articles to be dispensed could be used, as will be apparent with those skilled in the art. Each container 32 can house various different types of prizes, for example, toys, useful tools of common use or the like, or tickets having predefined values for redemption for prizes.

The game 20 is played by user actuation of an external control panel 36 mounted to the front of the cabinet 22. The control panel 36 supports a handle 38, resembling a fishing rod handle, along with a simulated spool 40. Separately mounted in the interior of the cabinet 22 is a fishing rod 42 and associated line 44 and hook 46. As described more particularly below, the rod and line are controlled by a control system responsive to commanded movement from the handle 38 and spool 40 to manipulate the hook 46. Particularly, the fishing rod 42 can be pivoted side to side and back and forth. The line 44 can be wound or unwound. This enables the player to raise or lower the fishing hook 46 at any position in the play area space 28 as well as the prize container holding space 26 so that the hook 46 engages one of the loops 34 to capture the associated prize 30.

Figure 2:
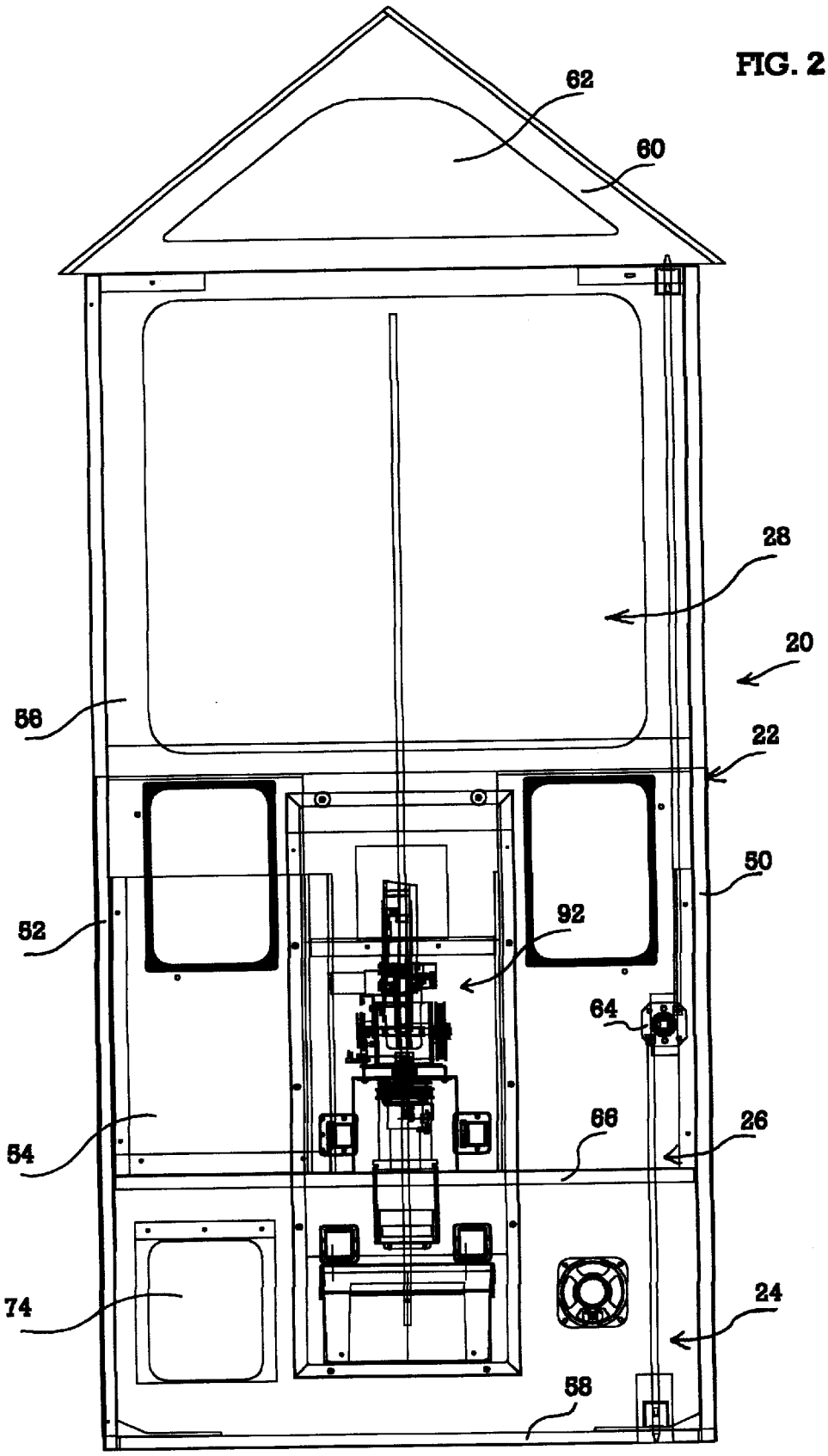
FIG. 2 is a front elevation, isometric view of a dispensing fishing game in accordance with the invention.
Figure 3:
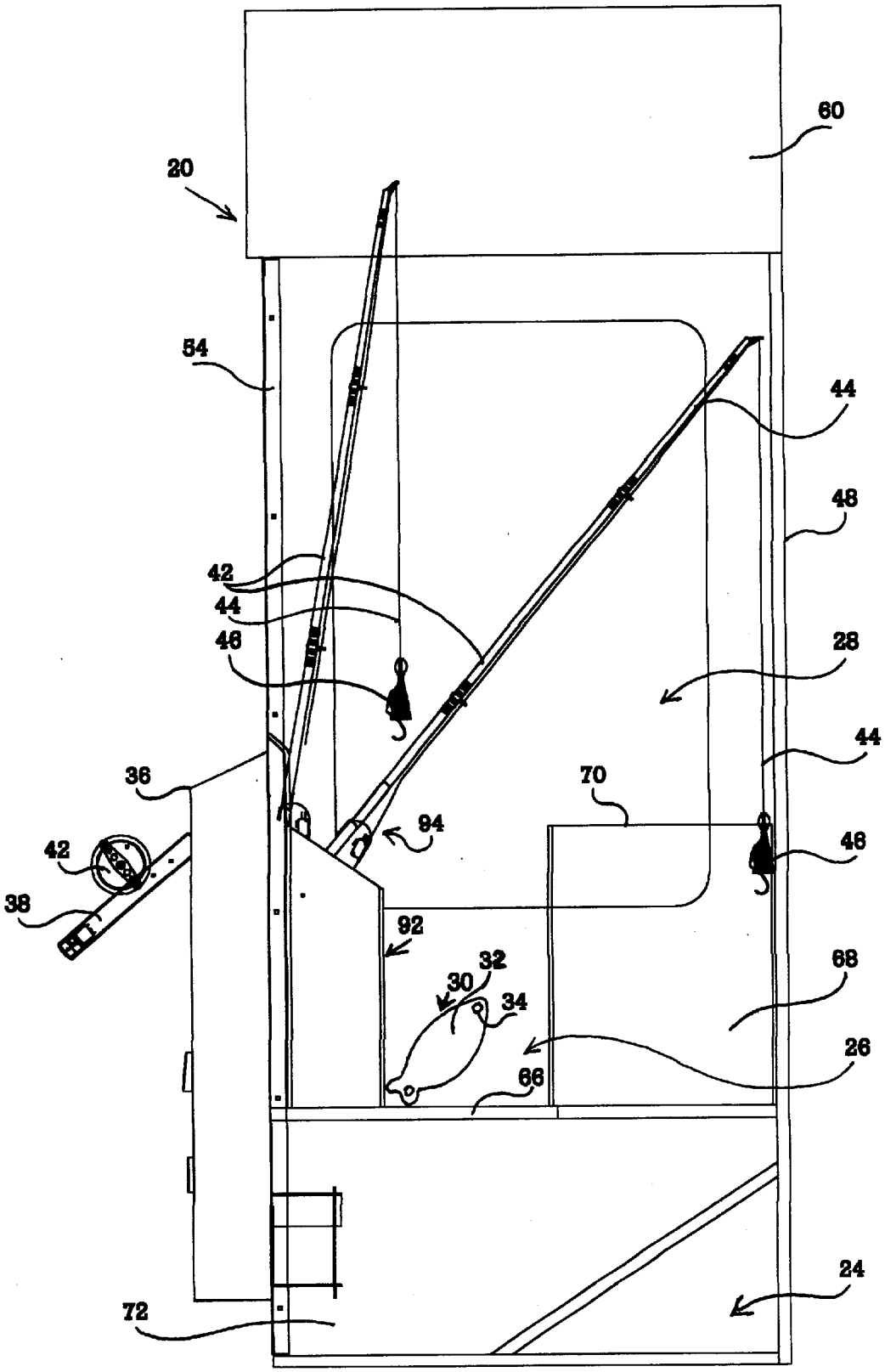
FIG. 3 is a right side elevation view of the dispensing fishing game of FIG. 2.
Figure 4:
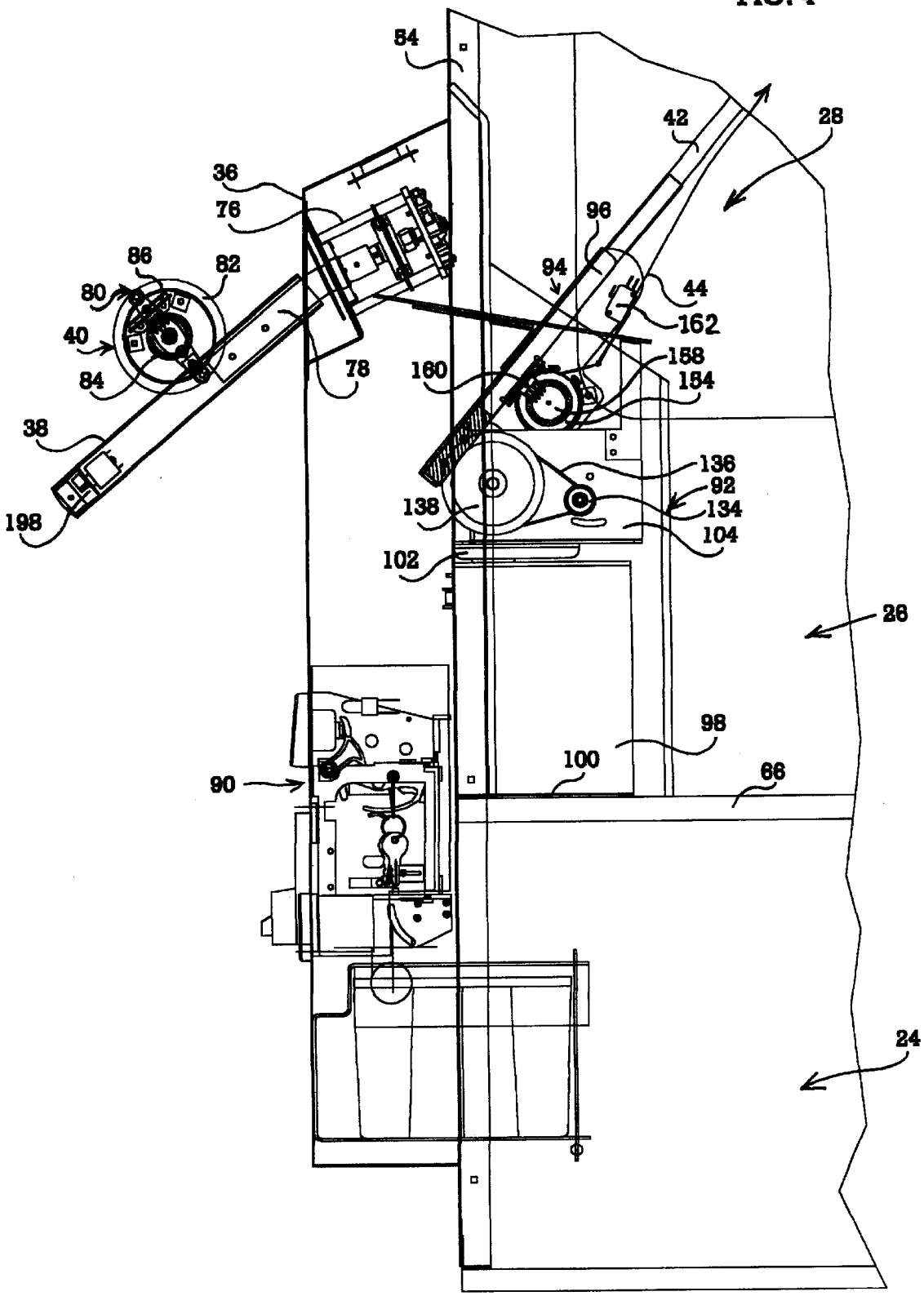
FIG. 4 is a partial isometric right side elevation view of the dispensing fishing game of FIG. 2.

Referring to FIGS. 2–4, the fishing game 20 is illustrated in greater detail omitting the artistic elements of the cabinet 22 illustrated graphically in FIG. 1. Particularly, FIGS. 2 and 3 comprise an isometric view of the front and right side, respectively, of the cabinet 20.

The cabinet 20 comprises a back wall 48 connected between a right side wall 50 and a left side wall 52. A front door 54 is hingedly mounted to the left side wall via a continuous hinge 56. A bottom wall 58 is provided at the bottom of the cabinet 22, while a peaked top 60 encloses the top of the cabinet 22 and includes a marquee and light area 62. A conventional latching mechanism 64 is mounted to the front door 54 for selectively latching to the bottom wall 58 and the top 60 in a conventional manner. The side walls 50 and 52 and front door 54 are at least partially of glass or the like so that the holding space 26 and play area space 28 are visible.

A horizontal wall 66 positioned above the bottom wall 58 separates the dispensing space 24 from the prize container holding space 26. A prize chute 68 is positioned in a rear right corner of the prize container holding space 26 and includes an open top inlet 70. The chute 68 extends downwardly past the horizontal wall 66 and is turned forwardly to a dispensing outlet 72, see FIG. 3, which is selectively closed by a hinged chute door 74, see FIG. 2.

Referring to FIG. 4, the control panel 36 houses a joy stick mechanism 76 having an actuator 78 connected to the handle 38. The joy stick mechanism 76 is conventional in nature and includes four switches (not shown) actuated by the actuator 78 responsive to left, right and forward and back movement of the handle 38 and thus actuator 78. The spool 40 includes a handle 80 pivotally mounted to a housing 82 enclosing an encoder wheel 84 and optical sensor 86. Particularly, the handle 80 is operable to rotate the encoder wheel 84. The rotation of the encoder wheel 84 is sensed by the optical sensor 86.

Figure 10:
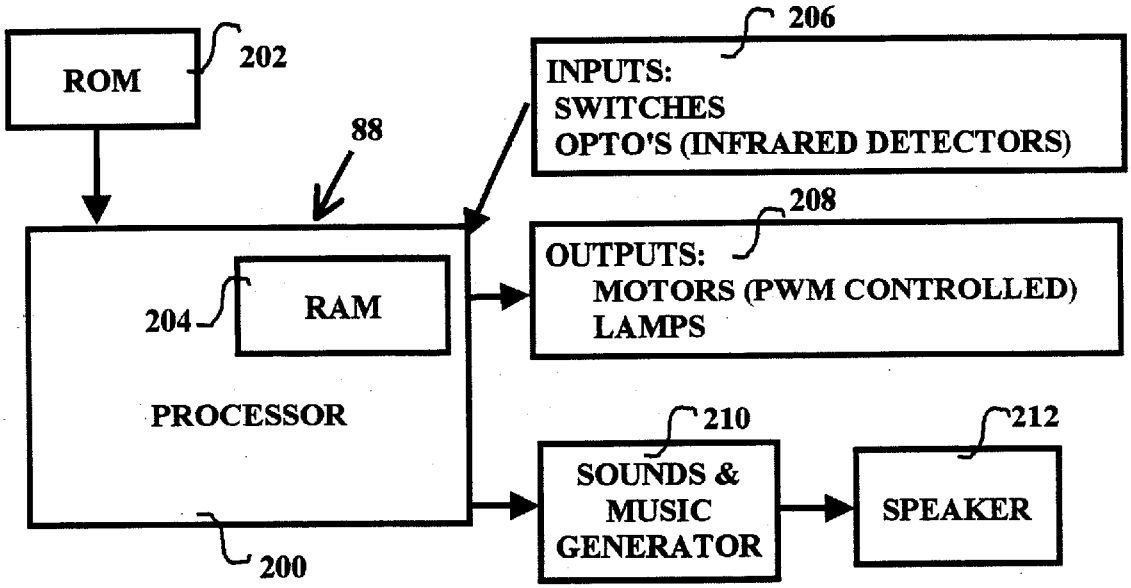
FIG. 10 is a block diagram of a control system of the dispensing game of FIG. 2.

The switches of the joy stick mechanism 76 and the optical sensor 86 comprise inputs 206 to a control system 88, see FIG. 10, for controlling operation of the game 20. The control system 88 is described more specifically below.

The control panel 36 also houses a coin operated mechanism 90 for enabling play of the dispensing fishing game 20. The control panel 36 is mounted to the door 54.

Movement of the fishing rod 42 is controlled by a drive system 92 mounted in the cabinet 22. The drive system 92 controls movement of a boom 94. The boom 94 includes an elongated tubular bracket 96 telescopically receiving the fishing rod 42, as particularly shown in FIG. 4. As is apparent, the fishing rod 42 could be an integral element of the boom 94. As such, the tubular bracket 96 and the rod 42 would be the same. The drive system 92 controls movement of the boom 94 side to side and back and forth.

Figure 7:
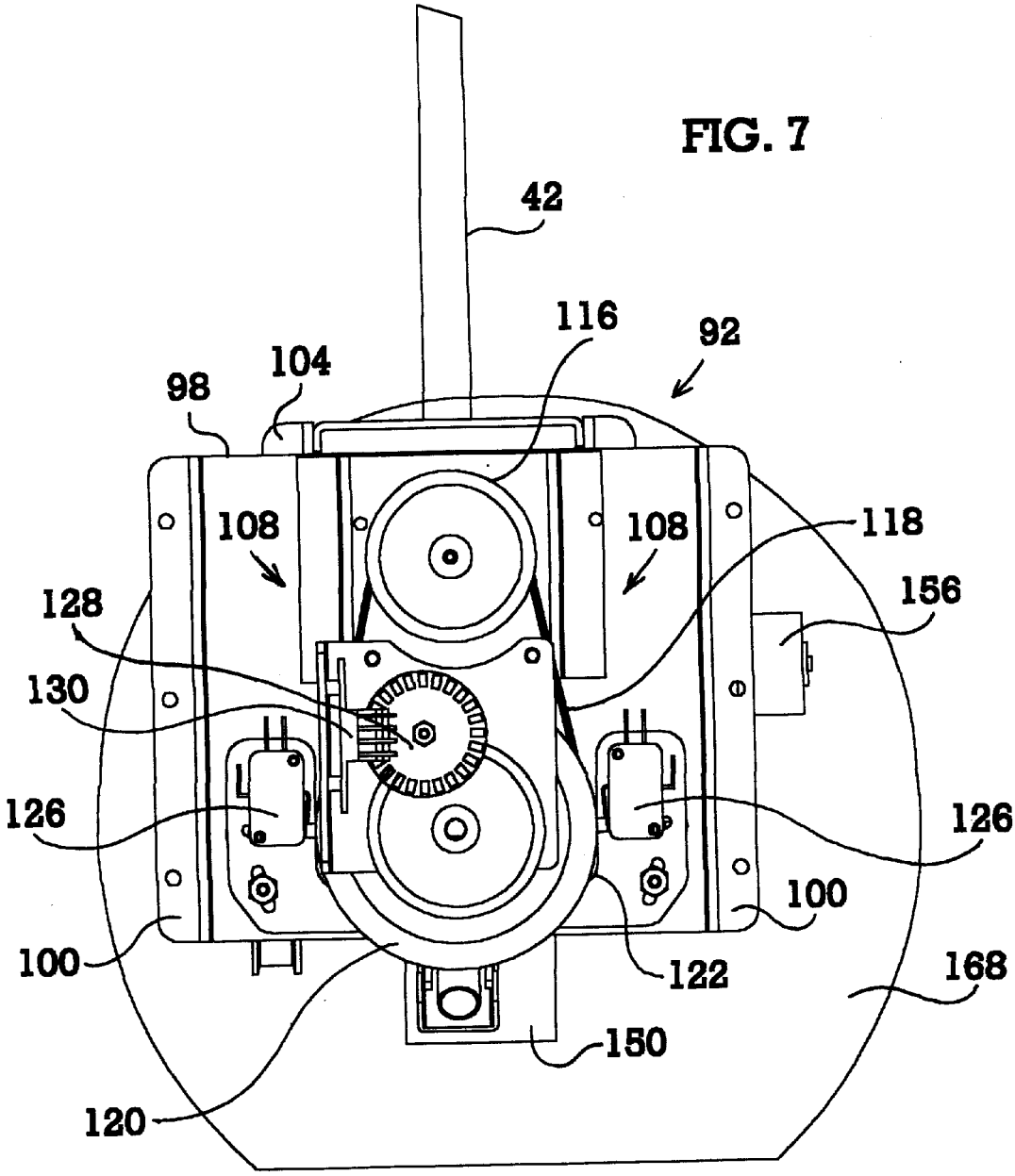
FIG. 7 is a bottom plan view of the boom mechanism of FIG. 5.

Particularly, the drive system includes a bracket 98 fixedly mounted in the cabinet 22. The bracket 98 comprises an inverted U-shaped bracket having opposite flanges 100, see FIG. 7, fixedly mounted to the horizontal wall 66 using screws or the like (not shown). A turntable 102 is rotatably mounted atop the bracket 98 and supports a frame 104. The boom 94 is pivotally mounted to the frame 104 for movement relative thereto. The drive system 92 includes a servo system 106 for controlling movement of the boom 94. The servo system 106 includes a first servo 108, see FIG. 7, for controlling rotation of the turntable 102, frame 104 and boom 94 about a vertical axis represented by a vertical shaft 110 and a second servo 112 for controlling rotation of the boom 94 about a horizontal axis represented by a horizontal shaft 114.

The first servo 108 is enclosed within the bracket 98. The first servo 108 includes a motor 116 fixedly mounted to an underside of the bracket 98 and driving a belt 118. The belt 118 drives a driven pulley 120 connected to the vertical shaft 110. The vertical shaft 110 also carries a cam 122 and the turntable 102. A bearing 124 is provided between the bracket 98 and the turntable 102. The cam 122 is operatively associated with limit switches 126. An encoder wheel 128 is driven by the driven pulley 120 via a gear mechanism (not shown). The gear mechanism provides an 8:1 ratio of the encoder wheel 128 to the driven pulley 120. Rotation of the encoder wheel 128 is sensed by an optical sensor 130.

The optical sensor 130 comprises an input for the control system 88 of FIG. 10. Likewise, the motor 116 comprises an output 208 controlled by the control system 88. The limit switches 126 are electrically connected in series with the motor 116 to disable the motor to prevent the fishing rod 42 from hitting the cabinet side walls 50 and 52.

Figure 5:
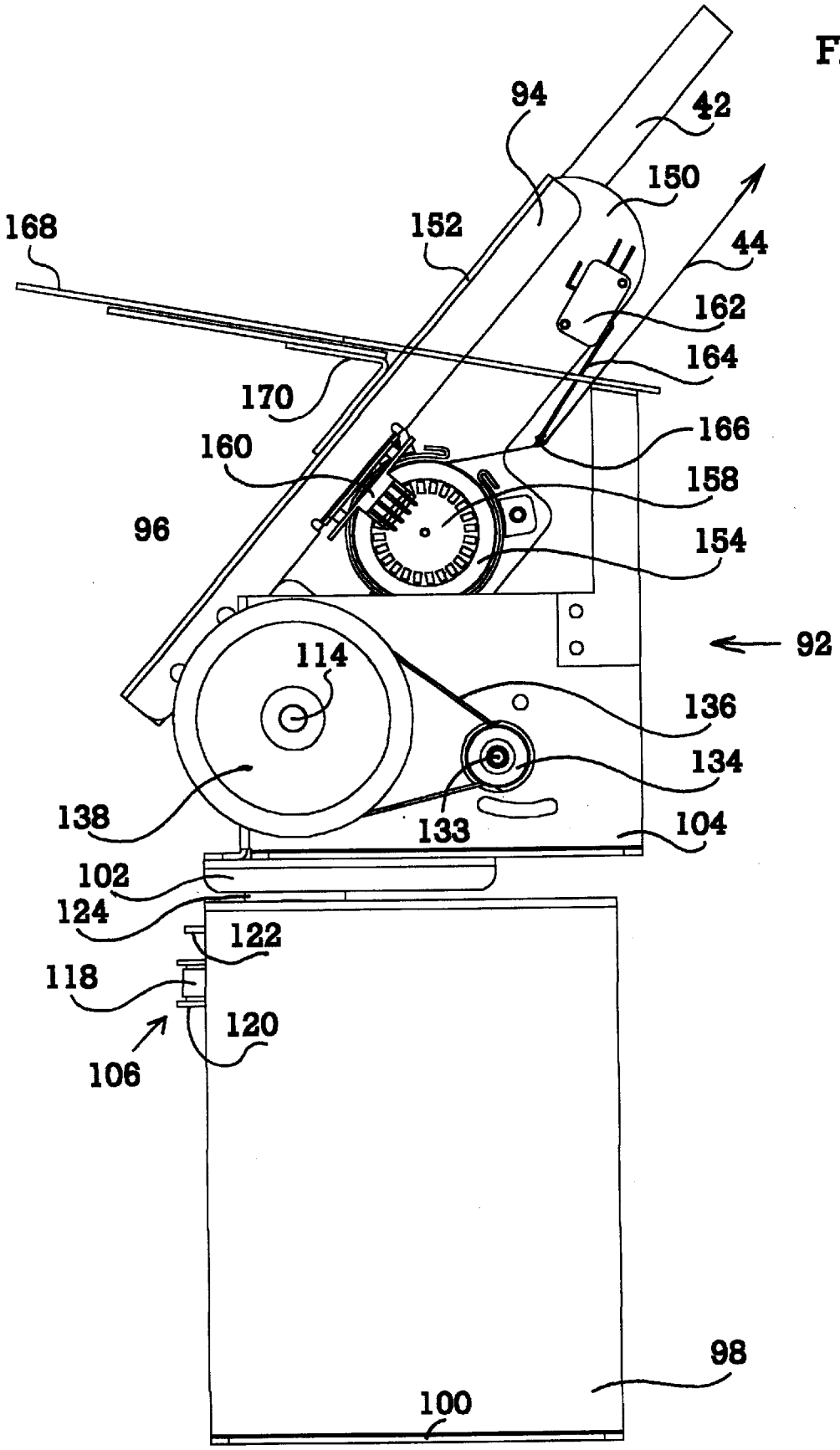
FIG. 5 is a right side elevation of a boom mechanism of the dispensing fishing game of FIG. 2.

The second servo 112 comprises a motor 132 mounted to the frame 104. The motor 132 has a shaft 133 carrying a drive pulley 134, see FIG. 5, driving a belt 136. The belt 126 in turn drives a driven pulley 138. The driven pulley 138 is fixedly connected to the boom 94 via the horizontal shaft 114, for rotating the boom 94 about the horizontal axis represented by the shaft 114. A cam 140 is also carried on the horizontal shaft 114 and operates a pair of limit switches 142. The limit switches 142 are electrically connected in series with the motor 132 for preventing the rod 42 from contacting the cabinet rear wall 48 or front door 54. An encoder wheel 144 is also driven by the horizontal shaft 114 via a gear mechanism (not shown), providing an 8:1 ratio, as above. An optical sensor 146 senses rotation of the encoder wheel 144 and provides an input 206 to the control system 88, see FIG. 10. Likewise, the motor 132 comprises an output 208 for the control system 88.

Figure 6:
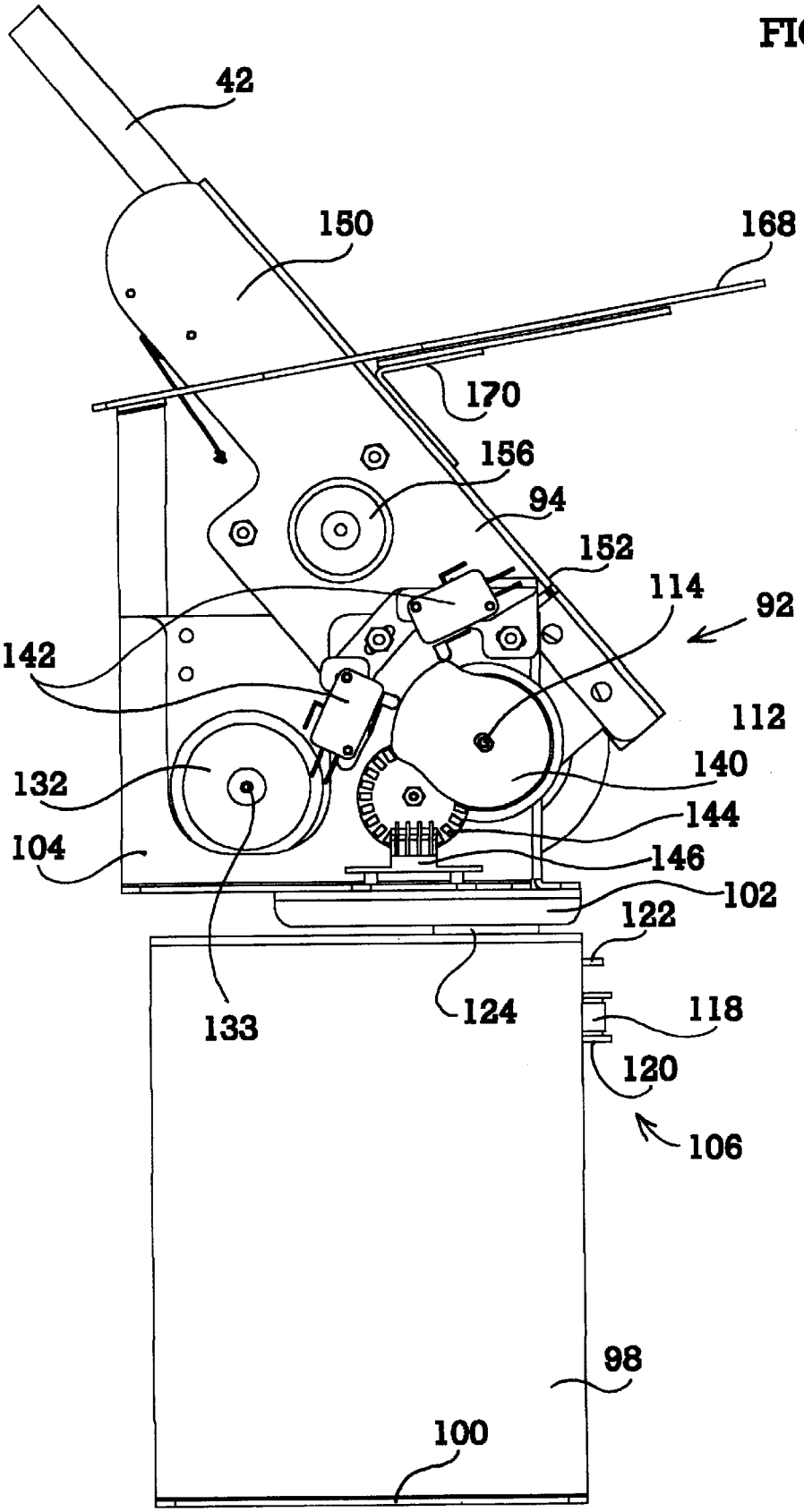
FIG. 6 is a left side elevation view of the boom mechanism of FIG. 5.

The boom 94 comprises a first plate 150 carrying the tubular bracket 96. The tubular bracket 96 telescopically receives the rod 42. A second plate 152 is fixed atop the tubular bracket 96 at a right angle to the first plate 150. The first plate 150 rotatably carries a spool 154. The line 44 is wound about the spool 154. The spool 154 is driven by a motor 156 mounted to the first plate 150, see FIG. 6. An encoder wheel 158 is connected to the spool 154 for rotation therewith. An optical sensor 160 senses rotation of the encoder wheel 158 and provides an input 206 to the control system 88, see FIG. 10. Likewise, the spool motor 156 comprises an output 208 for the control system 88. A limit switch 162 is mounted to the first plate 150 and includes an actuator 164. A distal end of the actuator 164 comprises a loop 166 receiving the line 44. The limit switch 162 comprises an input 206 for the control system 88, see FIG. 10. The limit switch 162 senses slack in the line 44 indicating that the hook 46 has bottomed. This is used by the control system 88 to disable further unwinding of the line 44.

A circular plate 168 is mounted to the second plate 152 via a bracket 170. The circular plate 168 acts as a cover for the drive system 92.

As described, the drive system 92 controls movement of the boom 94 side to side via the first servo 108. Particularly, the motor 116 is driven to rotate the vertical shaft 110 to turn the frame 104 and thus the boom 94 side to side. Similarly, the second servo 112 is operated by the second motor 132. Rotation of the motor 132 rotates the horizontal shaft 114 to move the boom 94 back and forth. As such, the rod 42 being received in the boom 94 is controlled by the drive system 92 to move side to side and back and forth within the play area space 28.

Figure 8:
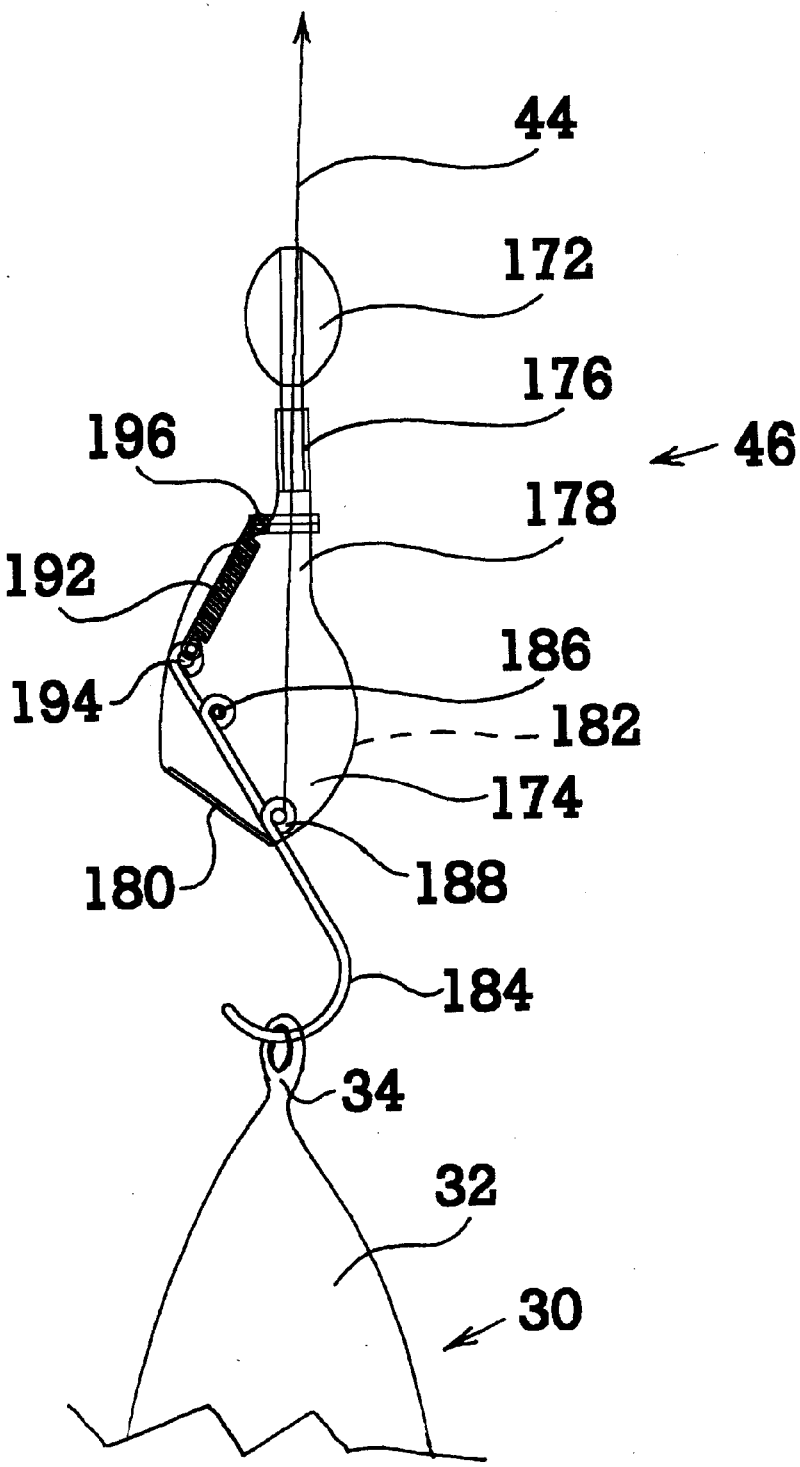
FIG. 8 is a side elevation view of a spring actuated hook in accordance with the invention with a captured prize.
Figure 9:
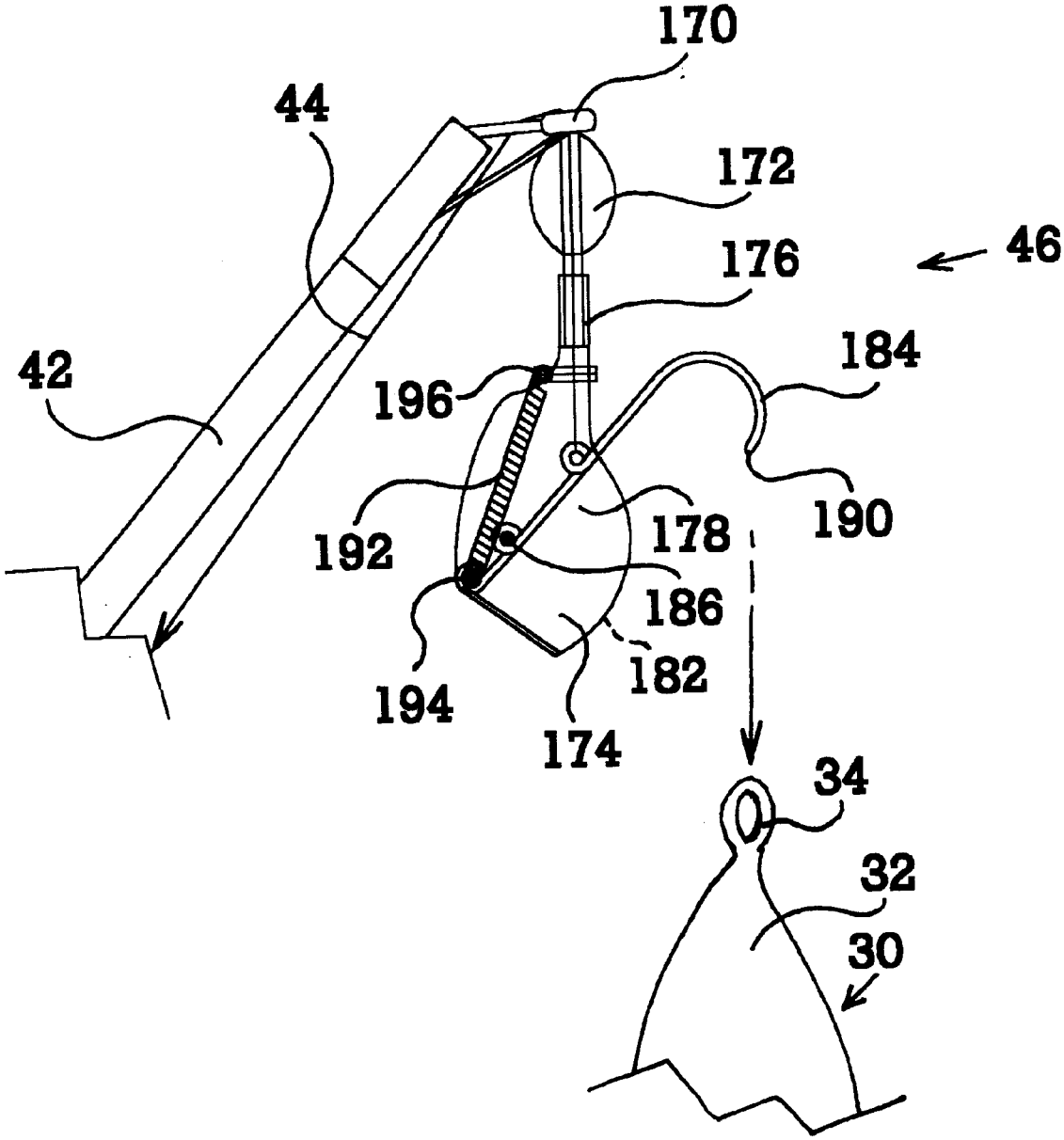
FIG. 9 is a view similar to that of FIG. 8 showing actuation of the hook to release a captured prize.

Referring to FIGS. 8 and 9, the hook 46 comprises an actuable hook for automatically releasing a prize 30. Particularly, the line 44 extends downwardly from a distal end 170 of the rod 42. The line 44 passes downwardly through a weight 172 into a shell 174. The shell 174 includes an upper neck 176 opening into a bulb 178 having a bottom wall 180 and rear slot 182. A hook element 184 is pivotally mounted in the shell 174 at a pivot 186. The line 44 is tied about a loop 188 disposed between the pivot 186 and a tip 190. A spring 192 connects to a looped end 194 of the hook element 184 and to the shell 178 at a stud 196. The spring 192 normally biases the hook element 184 to a downward position as shown in FIG. 8 with the tip 190 received in the container loop 34. To automatically release the prize 30, the line 44 is wound until the weight 172 engages the rod distal end 170. At the same time the neck 176 engages the weight 172 which prevents further upward movement of the shell 174. By continuing to wind the line 44, the hook element 184 is pulled upwardly against force of the spring 196 about the pivot 186 until it reaches an uppermost position shown in FIG. 9. At the uppermost position the tip 190 is withdrawn from the loop 34 to release the container 32 and drop the prize 30.

While the illustrated embodiment of the invention uses a spring to actuate the hook 184, other schemes could be used, such as providing a weighted hook.

Referring to FIG. 10, the control system 88 is illustrated in block diagram form. The control system 88 includes a processor 200 including associated ROM memory 202 and RAM memory 204. In the illustrated embodiment to the invention, the RAM memory 204 is illustrated as a component of the processor 200, while the ROM memory 202 is separate. As will be apparent, the ROM memory 202 and RAM memory 204 could be an integral component of the processor 200 or a separate component, as necessary or desired.

The processor 200 is operatively connected to various input elements, see block 206, as discussed above. The input elements include switches of the joy stick mechanism 76, see FIG. 4, and may also include the limit switches 126, 142 and 162. Likewise, the input elements include the optical sensors 86, 130, 146 and 160. Output elements 208 include the motors 116, 132 and 156. In the illustrated embodiment of the invention, the motors are controlled using pulse width modulation. Other output elements include various lamps housed within the cabinet 22, as will be apparent. Likewise, the processor 20 is connected to a sound and music generator circuit 210 for driving a speaker 212, see FIG. 2, for providing audio feedback to a user.

The control system 88 operates in accordance with a control program stored in the ROM 202 and data stored in the RAM memory 204. The control program controls operation of the fishing game. The data includes input from the input devices 206 as well as information such as amount of money inserted by a user for playing a game.

The basic operation of the program processor 200 is to sense movement commanded via the user control panel 36 to provide corresponding control of the drive system 92. Particularly, the processor 200 is operable to sense left and right movement of the handle 38 and command related left and right movement of the boom 94 and thus the fishing rod 42. Likewise, back and forth, or up and down, movement of the handle 38 is sensed to command corresponding back and forth, or up and down, movement of the boom 94 and thus the fishing rod 42. Similarly, rotation of the spool 40 is sensed to command rotation of the spool 154 to wind or unwind the line 44. Particularly as is evident in FIG. 4, the user control panel 36 is not mechanically linked to the drive system 92. Nevertheless, the drive system 92 is controlled responsive to movement commanded via the user control panel 36 to simulate the fishing experience.

Figure 11:
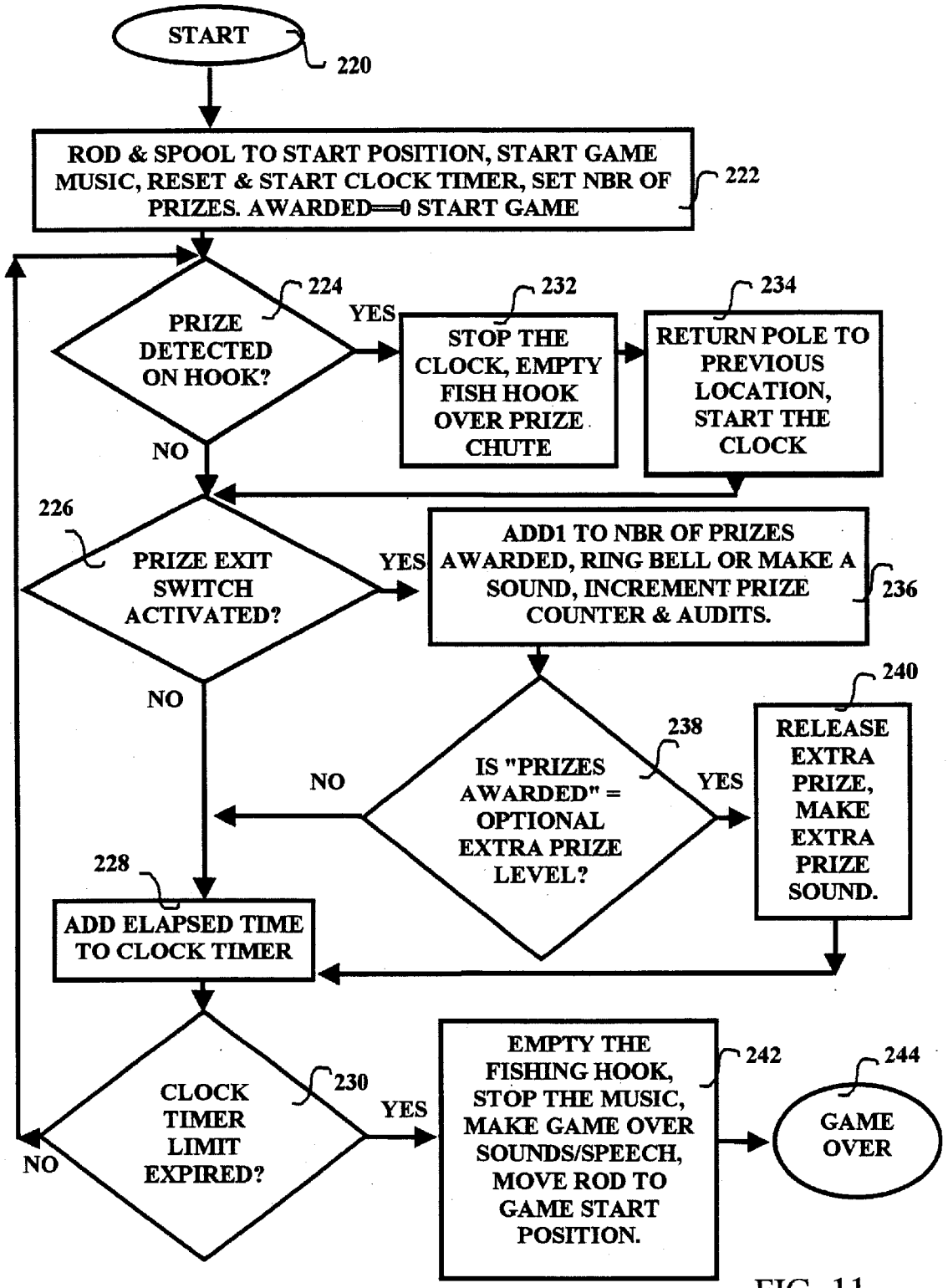
FIG. 11 is a flow diagram illustrating operation of a program implemented by the processor of FIG. 10.

Referring to FIG. 11, a flow diagram illustrates operation of a program implemented in the processor 200 for play of the fishing game 20. The program begins at a start node 220 after coins are inserted in the coin dispenser 90. The cost of a game can be selected as desired. A block 222 initializes operation by moving the rod 42 and spool 154 to a select start position. Game music is then started. A clock timer is reset and started. A number of prizes awarded is set to zero. Particularly, the clock timer can be used to set duration of the game. This can be varied to provide different skill levels. Duration can be unlimited for a merchandise or redemption game. The game is then started by controlling movement of the rod 42 and line 44 to provide the remote controlled fishing experience. As described, during game play, the user manipulates the handle 38 to move the rod 42 from side to side or back and forth. Likewise, the spool 40 is turned to selectively wind or unwind the line 44. FIG. 3 illustrates the rod 42 in a back position in dark line, and in a forward position in light line. The start position can be any desired position within the play area space 28. The objective of the game is to insert the hook 46 into one of the container loops 34 to capture a prize.

Operation of the control program proceeds to a decision block 224 which determines if a prize is detected on the hook 46. A prizes is detected based on speed of the spool motor 156 at a set voltage detected by speed of the spool and coder wheel 158. If not, then a decision block 226 determines if a prize exit switch is activated. The prize exit switch is associated with the chute outlet 72 for sensing if a prize has passed through the chute 68. If not, then a block 228 adds an elapsed time to the clock timer. A decision block 230 determines if the clock timer limit has expired. If not, then control loops back to the decision block 224.

If a prize is detected on the hook 46, as determined at the decision block 224, then a block 232 stops the clock and enables a vibrator element 198 in the handle 35, see FIG. 4. This provides an indication to the user that prize has been captured. Next the program empties the fish hook 46 over the prize chute inlet 70. This is done by automatically controlling the boom 94 to position the rod distal end 170, see FIG. 9, above the chute inlet 70, see FIG. 3. The line 44 is then wound onto the spool 154 until the prize 30 is released, as shown in FIG. 9. The prize then drops down through the chute inlet 70 into the chute 68 to the outlet 72 and activates the prize exit switch (not shown). A block 234 then returns the fishing rod 42 to the previous location and restarts the clock. Control then proceeds to the decision block 226.

If the prize exit switch is activated at the block 226, then a block 236 increments the number of prizes awarded during the game. A bell is rung or other sound is generated on the speaker 212. A prize counter is incremented as part of an auditing function. A decision block 238 then determines whether the number of prizes awarded in the game is equal to an optional extra prize level. If not, then control proceeds to the block 228. If so, then an extra prize is released at a block 240. The extra prize would be released by a solenoid actuator, or the like, not shown, for delivery to the chute outlet 72. A further sound is generated to indicate that an extra prize has been awarded.

If the clock timer limit has expired, as determined at the decision block 230, then a block 242 is operable to empty the fish hook to release any captured prize back into the prize container holding area 26. Music is stopped and a game over sound or speech is played on the speaker 212. The rod 42 is then moved to the game start position. The game ends at a node 244.

Thus, in accordance with the invention, there is provided a dispensing game 20 comprising a cabinet 22. A plurality of prizes 30 are stored in the cabinet 22. Each prize 30 includes an associated container 32 having a loop 34. An elongate boom 94 has a near end defined by the tubular bracket 96 receiving the rod 42 and a far end defined by the rod distal end 170, see FIG. 9. The boom 94 is movably mounted in the cabinet 22. The spool 154 carries the line 44 with a hook 46 on a distal end of the line. The spool 154 is rotatably mounted relative to the boom 94 with the line 44 being carried proximate the rod 42 with the hook 46 hanging downwardly from the far end 170. The drive system 92 controls movement of the boom 94 and rotation of the spool 154. The user control panel 36 is mounted to the cabinet 22 and commands movement of the boom 94 and the line 44. The control system 88 is operatively connected to the inputs 206 and outputs 208 associated with the drive system 92 and the user control panel 36 for controlling the drive system 92 responsive to the commanded movement. As a result, the hook 46 can be manipulated to engage one of the loops 34 and capture the associated prize 30.

Figure 12:
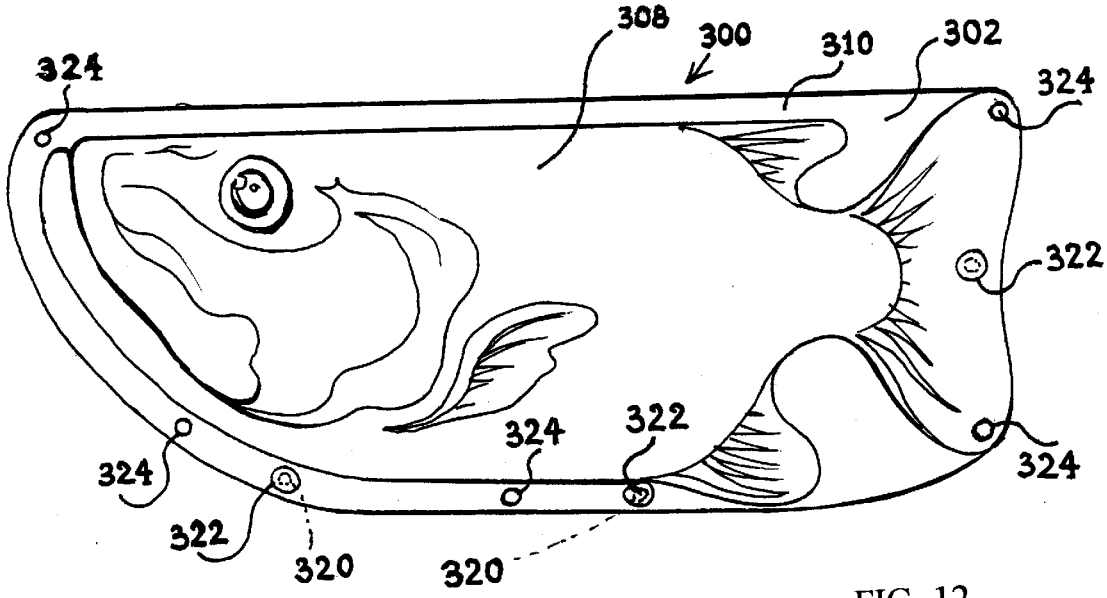
FIG. 12 is a plan view of a prize container according to one embodiment of the invention.
Figure 13:
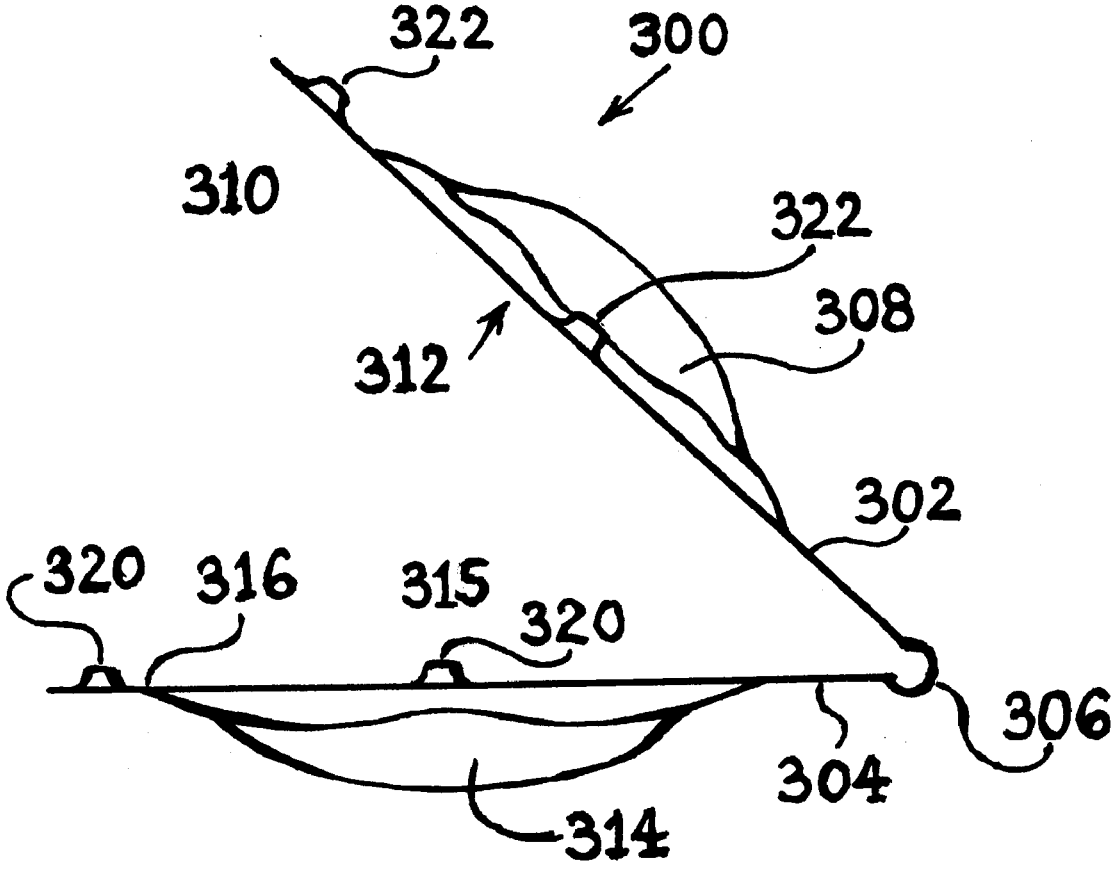
FIG. 13 is a side end view of the prize container of FIG. 12 in an open position.

Referring to FIGS. 12 and 13 a prize container 300 according to an alternative embodiment of the invention is illustrated. The prize container 300 is formed from a single sheet of transparent plastic to resemble a fish. Such a container is often referred to as a clam shell design. Particularly, the container 300 comprises a top half or part 302 and a bottom half or part 304 connected along a fold line 306 defining a living hinge. The top half 302 comprises a formed body 308 surrounded by an edge flange 310. The formed body 308 defines a downwardly opening space 312. Similarly, the bottom half 304 comprises a formed body 314 surrounded by an edge flange 316 to define an upwardly opening space 318. The top half 302 is a mirror image of the bottom half 304. A plurality of closing buttons 320 extend upwardly from the bottom half flange 316. Similarly, a plurality of closing buttons 322 extend upwardly from the top half flange 310. The top half closing buttons 322 are slightly larger than the bottom half closing buttons 320. The buttons 320 and 322 are provided in similar locations on the respective flanges 316 and 310.

FIG. 13 illustrates the container 300 in an open position. In this position, a prize to be dispensed can be placed in either space 318 or 312. The halves 302 and 304 are moved together about the fold line 306 until the bottom closing buttons 320 are received in the top closing buttons 322. The closing buttons 320 and 322 cooperate to maintain the container 300 in a closed position. The prize is captured in the collective space formed by the spaces 318 and 312. A plurality of holes or through openings 324 extend through both flanges 310 and 316, to define loops. As such, the openings 324 can be engaged by the hook 184, see FIG. 8, to capture a prize.

Figure 14:
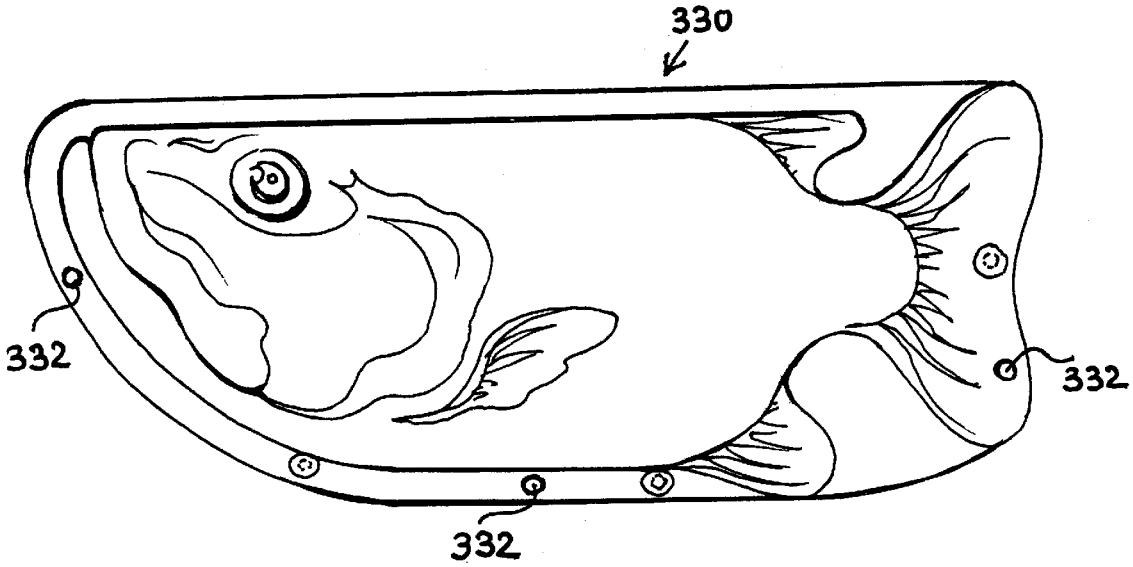
FIG. 14 is a plan view of a prize container according to a second embodiment of the invention.

To vary the skill level of the games, the openings 324 can be varied in size and number. Particularly, making the holes 324 smaller renders the game more difficult. Likewise, providing fewer holes 324 makes the game more difficult. FIG. 14 illustrates an alternative prize container 330 which is similar to the prize container 300 of FIG. 12, except that three openings 332 are provided, rather than five as in the container 300. Additionally, the openings 332 are larger.

In the illustrated embodiment of the invention, the openings 324 and 332 are selected to be in the range of ⅛" to ⅜", with ½" being an average. A ⅛" opening would require substantially greater skill to capture a prize than would a ⅜" opening. As is apparent, the present invention is not intended to be limited to openings of these sizes.

Thus, in accordance with the invention, a dispensing game is provided which is a typically game of skill. A positive result occurs if the hook is received in the container loop. The captured prize is then delivered to the chute without fear of losing the prize.

We claim:

1. A dispensing game comprising:

a cabinet;

a plurality of prizes stored in the cabinet, each said prize comprising an associated loop;

an elongate boom having a near end and a far end, the boom being moveably mounted in the cabinet;

a spool carrying a line with a hook on a distal end of the line, the spool being rotatably mounted in proximity to the boom near end, the line being carried by the boom with the hook hanging downwardly from the boom far end;

drive means for controlling movement of the boom and rotation of the spool;

user control means mounted to the cabinet for commanding movement of the boom and the line; and a control system operatively connected to the drive means and the user control means for controlling the drive means responsive to the commanded movement, wherein the hook can be manipulated to engage one of the loops and capture the associated prize.

2. The dispensing game of claim 1 wherein said user control means comprises a joystick.

3. The dispensing game of claim 1 wherein the prizes comprise transparent container carrying an article to be dispensed.

4. The dispensing game of claim 1 wherein the control system detects a captured prize responsive to speed of the spool.

5. The dispensing game of claim 4 further comprising means for vibrating the user control means responsive to the control system detecting a captured prize.

6. The dispensing game of claim 1 further comprising a dispenser operatively associated with the cabinet for receiving a prize engaged by the hook.

7. The dispensing game of claim 6 wherein the hook comprises a spring loaded hook that can be selectively pivoted by the line to release the prize into the dispenser.

8. The dispensing game of claim 6 wherein the control system is operable to automatically move the prize to the dispenser responsive to the user capturing one of the prizes.

9. The dispensing game of claim 1 wherein the drive means comprises a servo system for controlling movement of the boom.

10. The dispensing game of claim 9 wherein the servo system comprises a first servo for controlling rotation of the boom about a vertical axis and a second servo controlling rotation of the boom about a horizontal axis.

11. The dispensing game of claim 1 wherein the drive means comprises a motor for driving the spool to wind and unwind the line.

12. The dispensing game of claim 1 wherein the control system disables unwinding of the line responsive to sensing slack in the line.

13. The dispensing game of claim 12 wherein speed of the spool is sensed by a spool encoder.

14. The dispensing game of claim 1 wherein each said prize comprises a one piece container having first and second parts selectively movable relative to one another between an open position and a closed position.

15. The dispensing game of claim 14 wherein the container comprises a transparent plastic container and the first and second parts are pivotal about a living hinge.

16. The dispensing claim of claim 14 wherein the container has a plurality of holes defining said loops.

17. The dispensing game of claim 16 wherein the holes have a select diameter in the range of ⅛" to ⅜" to vary skill level of the dispensing game.

18. A dispensing fishing game comprising:

a cabinet;

a plurality of prizes stored in the cabinet, each said prize comprising an associated loop;

an elongate fishing rod having a near end and a far end, the fishing rod being moveably mounted in the cabinet;

a spool carrying a line with a hook on a distal end of the line, the spool being rotatably mounted in proximity to the fishing rod near end, the line being carried by the boom with the hook hanging downwardly from the fishing rod far end; p1 drive means for controlling movement of the fishing rod and rotation of the spool; user control means mounted to the cabinet for commanding movement of the fishing rod and the line; and a control system operatively connected to the drive means and the user control means for controlling the drive means responsive to the commanded movement, wherein the hook can be manipulated to engage one of the loops and capture the associated prize.

19. The dispensing fishing game of claim 18 wherein said user control means comprises a joystick.

20. The dispensing fishing game of claim 18 wherein said user control means comprises a handle and fishing spool.

21. The dispensing fishing game of claim 18 wherein the prizes comprise transparent container carrying an article to be dispensed.

22. The dispensing fishing game of claim 21 wherein the containers comprise fish shaped containers.

23. The dispensing fishing game of claim 18 further comprising means for vibrating the user control means responsive to the hook engaging one of the loops.

24. The dispensing fishing game of claim 18 further comprising a dispenser operatively associated with the cabinet for receiving a prize engaged by the hook.

25. The dispensing fishing game of claim 24 wherein the hook comprises a spring loaded hook that can be selectively pivoted by the line to release the prize into the dispenser.

26. The dispensing fishing game of claim 18 wherein the drive means comprises a servo system for controlling movement of the rod.

27. The dispensing fishing game of claim 26 wherein the servo system comprises a first servo for controlling rotation of the rod about a vertical axis and a second servo controlling rotation of the rod about a horizontal axis.

28. The dispensing fishing game of claim 18 wherein the drive means comprises a motor for driving the spool to wind and unwind the line.

29. The dispensing fishing game of claim 18 wherein the control system disables unwinding of the line responsive to sensing slack in the line.

30. The dispensing fishing game of claim 18 wherein the control system detects a captured prize responsive to speed of the spool.

31. The dispensing fishing game of claim 30 wherein speed of the spool is sensed by a spool encoder.

32. The dispensing fishing game of claim 18 wherein the control system comprises a programmed processor.

33. The dispensing fishing game of claim 32 wherein the processor is programmed to vary control duration of play of the game to vary difficulty.

34. The dispensing fishing game of claim 18 wherein the hook comprises a spring actuated hook.

35. The dispensing fishing game of claim 18 further comprising a downwardly opening shell and the hook is pivotally mounted in the shell with the line extending through an opening in the shell and is secured to the hook, wherein when the shell engages the rod, the hook is pivoted upwardly to release the captured prize.

36. The dispensing fishing game of claim 35 further comprising a spring connected to the shell and the hook for biasing the hook downwardly.

37. The dispensing game of claim 18 wherein each said prize comprises a one piece container having first and second parts selectively movable relative to one another between an open position and a closed position.

38. The dispensing game of claim 18 wherein the container comprises a transparent plastic container and the first and second parts are pivotal about a living hinge.

39. The dispensing claim of claim 18 wherein the container has a plurality of holes defining said loops.

40. The dispensing game of claim 39 wherein the holes have a select diameter in the range of ⅛" to ⅜" to vary skill level of the dispensing game.

41. A dispensing fishing game comprising:

a cabinet;

a plurality of prizes stored in the cabinet, each said prize comprising an associated loop;

an elongate fishing rod having a near end and a far end, the fishing rod being moveably mounted in the cabinet;

a spool carrying a line with an actuable hook on a distal end of the line, the spool being rotatably mounted in proximity to the fishing rod near end, the line being carried by the boom with the hook hanging downwardly from the fishing rod far end;

drive means for controlling movement of the fishing rod and rotation of the spool; and a control system operatively connected to the drive means for controlling the drive means, wherein the hook can be manipulated to engage one of the loops and selectively capture and release the associated prize.

42. The dispensing fishing game of claim 41 wherein the actuable hook comprises a downwardly opening shell and a hook element pivotally mounted in the shell with the line extending through an opening in the shell and secured to the hook element, wherein when the shell engages the rod, the hook element is pivoted upwardly to release the captured prize.

43. The dispensing fishing game of claim 41 further comprising a spring connected to the shell and the hook element for biasing the hook element downwardly.

* * * * *